United States Patent [19]

Styck

[11] 4,174,128

[45] Nov. 13, 1979

[54] ANTI-RATTLE VEHICLE DOOR LATCH MECHANISM

[75] Inventor: Wayne G. Styck, Peoria, Ill.

[73] Assignee: Caterpillar Tractor Co., Peoria, Ill.

[21] Appl. No.: 816,628

[22] Filed: Jul. 18, 1977

[51] Int. Cl.[2] ..... E05C 3/08

[52] U.S. Cl. ..... 292/127; 292/341.12

[58] Field of Search ..... 292/DIG. 40, DIG. 41, 292/341.12, 341.13, DIG. 37, 127

[56] References Cited

U.S. PATENT DOCUMENTS

| | | | |
|---|---|---|---|
| 1,937,978 | 12/1933 | Miller | 292/127 |
| 2,812,205 | 11/1957 | Jakeway | 292/DIG. 37 |
| 3,044,287 | 7/1962 | Pelcin | 292/DIG. 37 |
| 3,161,426 | 12/1964 | Peras | 292/127 X |
| 3,281,176 | 10/1966 | McKey | 292/DIG. 41 |
| 3,610,668 | 10/1971 | Tixier | 292/341.12 |

*Primary Examiner*—Richard E. Moore
*Attorney, Agent, or Firm*—Phillips, Moore, Weissenberger, Lempio & Majestic

[57] ABSTRACT

An anti-rattle mechanism for automatically and releasably latching a door hinged to a vehicle body is disclosed. The mechanism comprises a cylindrical pin carried by a first mounting member which pin is compressively captured against an abutment surface on a second mounting member by a cam hook member pivotally carried by the second mounting member. The compressive capture of the cylindrical pin against the abutment surface by the cam hook member to provide automatic latching and anti-rattle features is described. A specific embodiment including minimum moving parts and providing for one-handed operation is disclosed.

10 Claims, 8 Drawing Figures

ANTI-RATTLE VEHICLE DOOR LATCH MECHANISM

The body of a heavy earth moving vehicle such as a motor grader, bulldozer, or the like, conventionally includes one or more doors hinged to the body and providing access to compartments formed in the body for replaceable elements such as batteries and the like or providing access to internal mechanisms of the vehicle. Various latching mechanisms have been proposed for such doors in the prior art. However, the latch mechanisms proposed in the prior art have not successfully met one or more of the design requirements for such latch mechanisms.

In the first place, it is highly desirable that the mechanism automatically latch the door when closed since if the door is not securely latched during operation of the vehicle, damage may result to the elements or internal mechanisms to be protected by the door due to the severe environmental conditions under which the vehicle is operated. It is also highly desirable that the latch mechanism be such as to prevent rattling of the door during operation of the vehicle since such rattling is distracting to the operator of the vehicle and will tend to produce accelerated wear of the door and latch mechanism due to the extreme environmental conditions to which the door and latch mechanism are subjected during operation of the vehicle. In addition, it is highly desirable that the latch mechanism be convenient and simple to operate when it is necessary to open the door.

Complicated latch mechanisms known in the prior art may be capable of satisfying some of the above design requirements. However, in the severe environmental conditions under which such vehicles are operated, complicated latch mechanisms tend to become jammed with dust and dirt and in addition, complicated latch mechanisms add undesirable cost in the manufacture and maintenance of the vehicle.

It is the primary object of this invention to provide a latch mechanism for a door hinged to the body of a heavy earth moving vehicle which latch mechanism is simple and inexpensive and yet provides for the automatic latching of the door upon closure in such a way that the door will not rattle during operation of the vehicle and yet the door may be easily and quickly unlatched to provide access to protected elements or internal mechanisms of the vehicle.

It is a further object of this invention to provide such a latch mechanism which may be adapted for use on a wide variety of different door designs located at various places in the body of a heavy earth moving vehicle.

SUMMARY OF THE INVENTION

According to this invention, an anti-rattle mechanism for automatically and releasably latching a door to a body, which door is movable through a given path from a fully open to a fully closed position is provided. Such mechanism includes first and second rigid support members, one of which is adapted to be mounted on the door and the other of which is adapted to be mounted on the body of the vehicle. A cylindrical pin is rigidly mounted on the first support member and projects therefrom with the axis of the pin extending normally to the given path of movement of the door. A cam hook member is mounted on the second support member for pivotal movement about a given axis parallel to the axis of the pin. A spring means urges the cam hook member to pivot in a given direction about the given axis and actuation means is provided for selectively causing the cam hook member to pivot in the direction opposite such given direction about such axis. The second support member has an abutment surface adapted to engage the periphery of the pin when the door is in its fully closed position on one side of the extended path defined with respect to the center of the pin when the door is moved from its fully open to its fully closed position. The cam hook member has a camming surface adapted to engage the periphery of the pin as the door approaches its fully closed position causing the cam hook member to pivot in the opposite direction from the direction in which it is urged to pivot by the spring means. The camming surface of the cam hook member terminates in a hooking surface adapted to receive the pin when the door is in its fully closed position and to compressively engage the periphery of the pin under the urging of the spring means at a point which is substantially opposite the engagement of the periphery of the pin by the abutment surface of the second support member. The capture of the pin against the abutment surface of the second support member by the cam hook member is adapted to support the free end of the door and to thereby prevent rattling of the door.

BRIEF DESCRIPTION OF THE DRAWING

The foregoing and other objects and features of this invention will be more fully apparent from a reading of the following detailed description of preferred embodiments when read in conjunction with the attached drawing wherein.

DETAILED DESCRIPTION OF PREFERRED EMBODIMENTS

Figure 1:
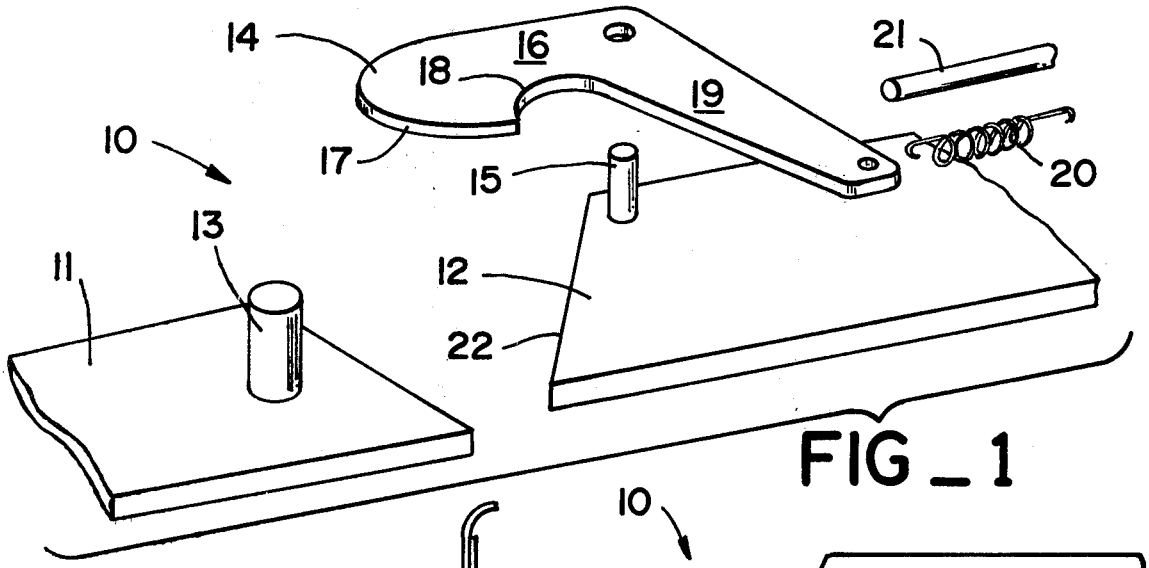
FIG. 1 is an exploded view of the essential elements of a latch mechanism in accordance with the teaching of this invention.

As shown in FIG. 1, a latch mechanism 10 according to the teaching of this invention is structurally simple and involves but two moving parts. The latch mechanism 10 includes a first support member 11 and a second support member 12. One of the support members 11, 12 is adapted to be mounted on the body of a vehicle and the other of the support members 11, 12 is adapted to be mounted on a door movable through a given path with respect to the body of the vehicle from a fully open position to a fully closed position, as will be more fully described hereinafter.

A cylindrical pin 13 is rigidly mounted on the first support member 11 with the axis of the cylindrical pin 13 extending normally to the given path through which the door is moved from its fully open to its fully closed position. A cam hook member 14 is mounted on the second support member 12 for pivotal movement about the axis of an axle 15 which is rigidly mounted on the second support member 12. As shown in FIG. 1, the cam hook member 14 includes a first portion 16 extending from the pivotal axis thereof about the axle 15 and providing a camming surface 17 and a hooking surface 18. The cam hook member 14 includes a second or shank portion 19 extending from the pivotal axis thereof transversely of the first portion 16.

A spring means in the form of a tension spring 20 having one end connected to the shank portion 19 of the cam hook member 14 and its other end fixedly mounted with respect to the second support member 12 urges the cam hook member 14 to rotate about the axis thereof provided by the axle 15 in a counterclockwise direction as shown in FIG. 1. Actuation means in the form of a plunger or rod 21 mounted for axial sliding movement with respect to the support member 12 is adapted to engage the shank portion 19 of the cam hook member 14 to selectively cause the cam hook member 14 to pivot in the opposite or clockwise direction as shown in FIG. 1 against the urging of the tension spring 20. The end of the second support member 12 is provided with an abutment surface 22 adapted to engage the periphery of the pin 13 when the door with which the latch mechanism is used is in its fully closed position.

Figure 2:
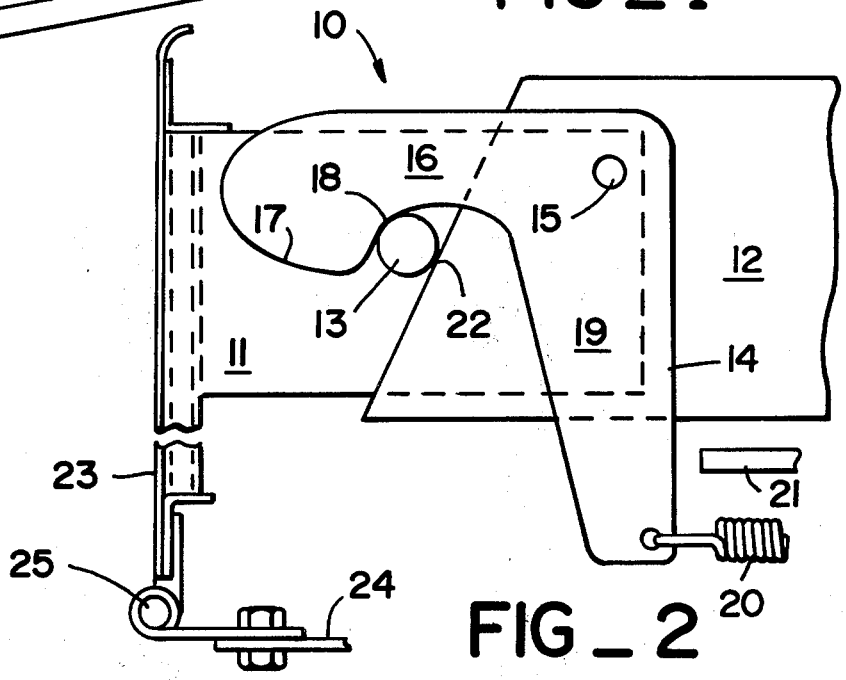
FIG. 2 is a top plan view of a latch mechanism in accordance with one embodiment of this invention showing the pin of the latch mechanism carried by a door hinged to the body of the vehicle.

Thus, referring to FIG. 2, the latch mechanism 10 of FIG. 1 is shown with the first support member 11 thereof mounted on a door 23 which is mounted for pivotal movement through a given arc with respect to the body 24 of the vehicle by means of a hinge 25. The door 23 is shown in its fully closed position with the abutment surface 22 of the second support member 12 in engagement with the periphery of the pin 13. The hooking surface 18 of the cam hook member 14 is urged into compressive engagement with the periphery of the pin 13 opposite the engagement of the pin 13 with the abutment surface 22 due to the action of the tension spring 20. Thus, the pin 13 is captured between the abutment surface 22 and the hooking surface 18 and the friction of these surfaces on the periphery of the pin 13 will tend to support the door 23 against movement in any direction and thereby prevent rattling of the door.

In order to open the door, the plunger or rod 21 is moved axially thereof against the shank portion 19 of the cam hook member 14 to cause it to pivot in a clockwise direction about the axle 15 against the force of the tension spring 20. The clockwise rotation of the cam hook member 14 will release the pin 13 and allow the door 23 to be opened. When the door is again closed, the periphery of the pin 13 will engage the camming surface 17 of the cam hook member 14 and again cause the cam hook member 14 to rotate in a clockwise direction until the pin 13 is again captured as shown in FIG. 2.

Figure 3:
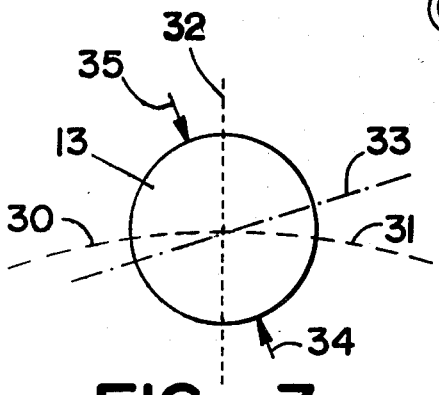
FIG. 3 is an enlarged top plan view of the cylindrical pin of a latch mechanism in accordance with the teaching of this invention with certain design features of the latch mechanism indicated schematically.
Figure 4:
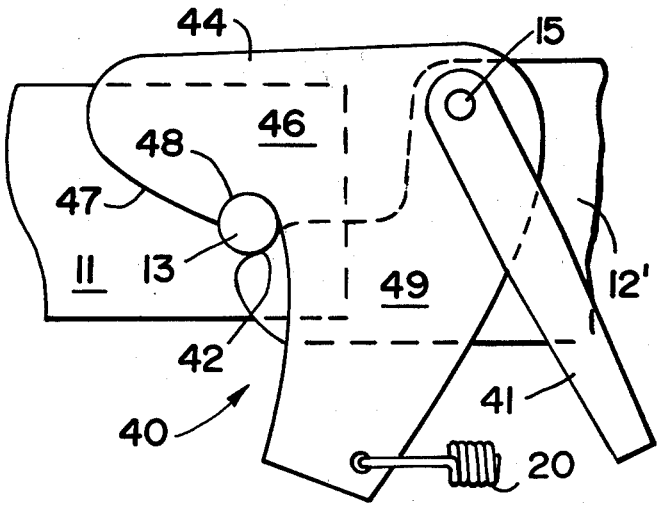
FIG. 4 is a fragmentary top plan view similar to that of FIG. 2 showing another embodiment of the latch mechanism according to the teaching of this invention.

Referring to FIGS. 3 and 4, it is noted that subject to certain limitations, the cam hook member of a latch mechanism according to the teaching of this invention together with its camming surface and hooking surface as well as the abutment surface of the second support member may take a variety of shapes. The camming surface of the cam hook member may be any inclined or curved surface adapted to cause the cam hook member to pivot against the force of the tension spring 20 when engaged by the pin 13 to enable the pin to be captured as described hereinabove upon closure of the door.

FIG. 3 illustrates schematically the limitations on the hooking surface and abutment surface of a latch mechanism according to the teaching of this invention with respect to the cylindrical pin 13. Thus a top plan view of the cylindrical pin 13 is shown in FIG. 3. The dashed line 30 represents the path of relative movement between the center of the pin 13 and the other elements of the latch mechanism as the door is moved from its fully open to its fully closed position. The dashed line 31 represents the extension of the path 30 beyond the fully closed position of the door and the dotted line 32 is a line drawn through the center of the pin 13 normal to the path 30 and its extension 31. The dot-dash line 33 is a line drawn through the center of the cylindrical pin 13 and the center of the axle 15 or given axis about which the cam hook member of the latch mechanism of this invention is pivoted.

The single headed arrow 34 represents the abutment of the pin 13 with the abutment surface of the second support member. The single heated arrow 35 represents the compressive engagement of the hooking surface of the cam hook member with the periphery of the pin 13 opposite the abutment 34.

According to the teaching of this invention, the abutment 34 and compressive engagement 35 of the pin 13 must occur on opposite sides of the extended path 30, 31 of relative movement between the pin 13 and the remainder of the latch mechanism. Also, according to the teaching of this invention, the abutment 34 and compressive engagement 35 of the periphery of the pin must occur on opposite sides of the dotted line 32. Finally, according to the teaching of this invention, the abutment 34 must occur on that side of the line 33 drawn through the center of the pin 18 and the axis of the axle 15 toward which the cam hook member pivots and on the same side of the line 32 as the axis of the axle 15. However, as shown in FIG. 4, the abutment 34 and compressive engagement 35 need not be confined to point contact as suggested in FIG. 2 but may be distributed over a substantial arc of the periphery of the pin 13.

Referring to FIG. 4, a latch mechanism 40 according to another embodiment of this invention similar to the embodiment of FIG. 2 is shown. The latch mechanism 40 of FIG. 4 includes a first support member 11 and cylindrical pin 13 that are essentially identical to the corresponding elements of the latch mechanism 10 of FIG. 2. However, the latch mechanism 40 includes a second support member 12' having an abutment surface 42 which engages a substantial portion of the periphery of the pin 13. Similarly, the cam hook member 44 of the latch mechanism 40 includes a hooking surface 48 which engages a substantial portion of the periphery of the pin 13.

The cam hook member 44 of the latch mechanism 40 is pivoted about the axis of an axle 15 and includes a first portion 46 having a camming surface 47 terminating in the hooking surface 48 similar to the corresponding elements of the latch mechanism 10. The cam hook member 44 also includes a second portion 49 extending normally to the first portion 46 thereof with a tension spring 20 connected thereto to urge the cam hook member 44 to pivot in a counterclockwise direction about the axle 15. A handle 41 connected to the cam hook member 44 is pivoted for selectively causing the cam hook member 44 to pivot in a clockwise direction about the axle 15 against the force of the tension spring 20. The handle 41 may be mounted on a shaft extending to the exterior of the body of the vehicle to enable the latch mechanism 40 to be conveniently operated.

According to the teaching of this invention and referring to FIGS. 3 and 4, the abutment 34 with the periphery of the pin 13 must occur on that portion of the periphery of the pin 13 between the dashed line 31 and the dotted line 32 on that side of the dot-dash line 33 toward which the cam hook member 44 is urged to move by the tension spring 20. Also, according to the teaching of this invention, the compressive hooking engagement 35 must occur on that portion of the periphery of the pin 13 between the dashed line 30 and the dotted line 32 opposite the abutment 34. However, as shown by the abutment surface 42 in FIG. 4, the abutment 34 may be distributed over that portion of the periphery of the pin 13 lying between the dotted line 32 and the dot-dash line 33 in embodiments of the teaching of this invention. If such abutment extends beyong the dotted line 32 and under the dashed line 30, it will tend to prevent the opening and closing of the door and abutment beyond the dot-dash line 33 toward the dotted line 32 will detract from the compressive gripping of the pin 13.

Similarly, as shown by the hooking surface 48 in FIG. 4, the compressive hooking engagement 35 may be distributed over that portion of the periphery of the pin 13 lying between the dashed line 30 and the dot-dash line 33 in embodiments of this invention. If the hooking engagement 35 extends beyond the dashed line 30 in a counterclockwise direction, it will tend to inhibit the release and capture of the pin 13 upon opening and closing of the door and if the compressive engagement 35 extends beyond the dot-dash line 33 in a clockwise direction, it will detract from the compressive gripping of the pin as well as tending to prevent the pivoting of the cam hook member about its axis.

Figure 5:
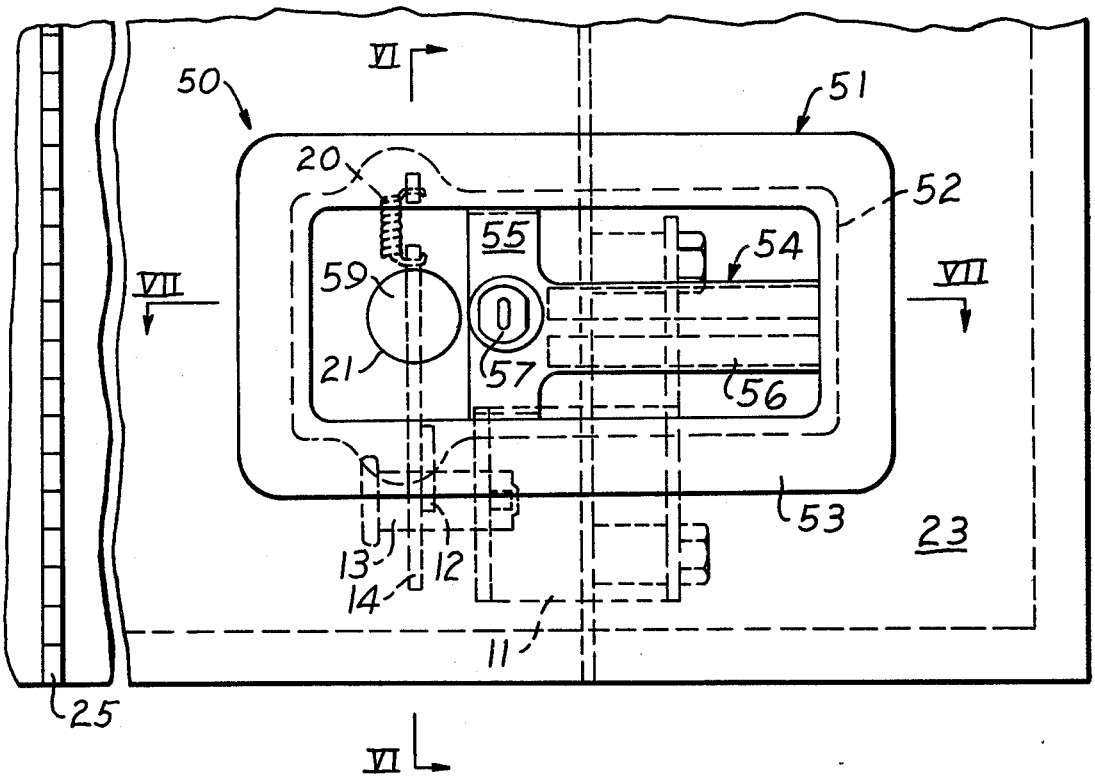
FIG. 5 is a front view in elevation of a further embodiment of the latch mechanism in accordance with the teaching of this invention with the pin of the latch mechanism mounted on the body of a vehicle and the remainder of the latch mechanism mounted on the door.
Figure 7:
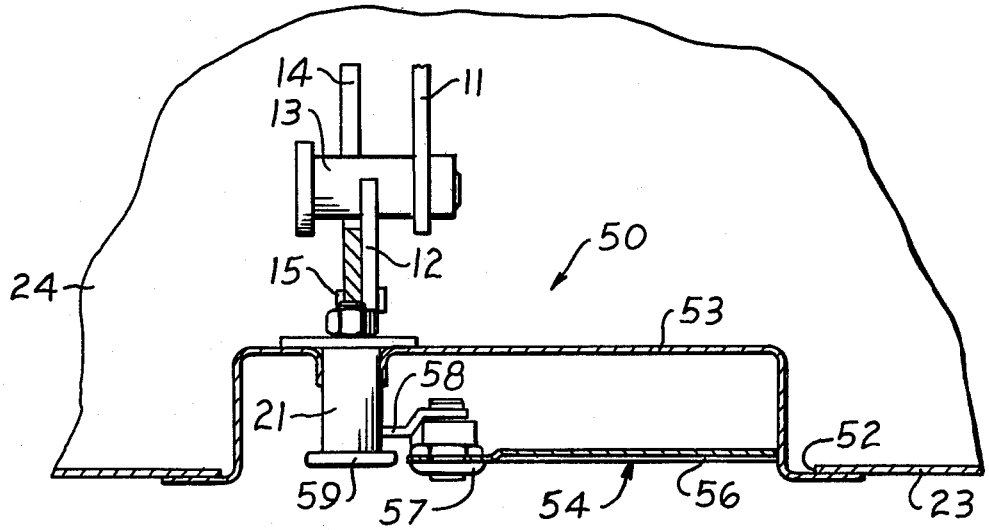
FIG. 7 is a view of the latch mechanism of FIG. 5 taken along line 7—7 of FIG. 5.
Figure 6:
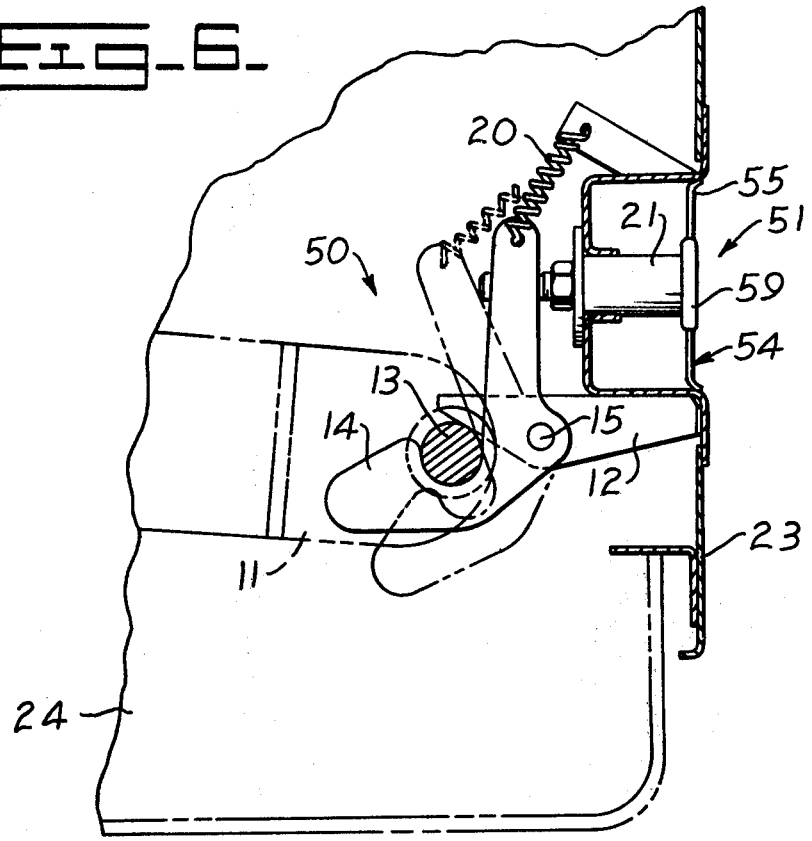
FIG. 6 is a view of the latch mechanism of FIG. 5 taken along lines 6—6 of FIG. 5 with the latch mechanism shown in its latched position by means of full lines and in its unlatched position by means of dotted lines.

Referring to FIGS. 5, 6 and 7, a preferred embodiment 50 of the door latch mechanism according to the teaching of this invention is shown in detail as mounted on the door of a compartment formed in a vehicle body. For purposes of clarity and to promote ease of understanding of this embodiment 50, the reference numerals of FIGS. 1 and 2 have been used to designate like elements of the latch mechanism embodiments 10 and 50.

As best shown in FIGS. 5 and 6, the first support member 11 carrying the cylindrical pin 13, is mounted on the body 24 of the vehicle. The second support member 12 carrying the cam hook member 14 is mounted on the door 23 which is hinged at 25 to the body 24 of the vehicle. Thus the embodiment 50 of the latch mechanism according to this invention differs from the embodiment 10 of FIGS. 1 and 2 in that the mounting of the two parts of the latch mechanism on the door and body, respectively, are reversed and in that the axis of the hinge is perpendicular to the axis of the pin of the latch mechanism rather than being parallel thereto.

According to this embodiment 50 of the latch mechanism according to this invention, that portion of the latch mechanism comprising the second support member 12, cam hook member 14, tension spring 20 and actuation means comprising plunger 21 are assembled as a unit together with a door handle 51 which may be mounted in an appropriate cut-out 52 in the door 23. The door handle 51 comprises a rectangular flanged cup 53 received through the opening 52 with the flange fixed to the door 23 about the periphery of the opening 52. The bottom of the cup 53 is apertured to receive the plunger 21 therethrough with a sliding fit toward one end of the rectangular cup 53. The second support member 12 is rigidly mounted at an exterior side surface of the cup 53 in operative relation to the plunger 21 so that the cam hook member 14 carried by the second support member 12 may be engaged by the plunger 21 as described hereinabove.

The rectangular cup 53 is provided with a T-shaped web 54 in the opening thereof with the cross bar 55 of the T-shape extending transversely of the rectangular cup 53 adjacent the plunger 21 and with the leg 56 of the T-shaped web extending along the axis of elongation of the cup 53 to the end thereof removed from the plunger 21.

The door handle 51 including the rectangular cup 53 and T-shaped web 54 are dimensioned so that the leg 56 of the T-shaped web may be grasped by the fingers of the average human hand and the plunger 21 operated by the thumb of such hand. Thus, referring to FIG. 6, the plunger 21 would be pushed inwardly by the thumb against the cam hook member 14 to move the cam hook member from the position shown in solid lines to the position shown in dotted lines against the force of the tension spring 20 to release the latch mechanism 50 so that the door 23 may be pivoted to its open position about the hinge 25.

As best shown in FIGS. 5 and 7, the door handle 51 may include a simple key operated lock mechanism 57. Such lock mechanism may comprise a lockable shaft carrying a dog 58 positioned in interfering relation to a flange 59 formed on the free end of the plunger 21 to prevent the plunger 21 from being operated unless the shaft is rotated by means of a key to remove the dog 58 from interfering relation with the flange 59.

As shown in FIG. 5, the door handle 51 is positioned for convenient operation by a right handed person. However, by positioning the door handle 51 so that the leg 56 of the T-shaped web extends vertically, the door handle 51 would be equally convenient in use by either a right handed or a left handed person. In this regard, it should be noted that the latch mechanism of this invention may either be positioned so that the axis of the pin 13 is parallel to the axis of the hinge 25, as shown in FIG. 2, or perpendicular to the axis of the hinge 25 as shown in FIG. 5. If the axis of the pin 13 is perpendicular to the axis of the hinge 25, then the path of relative motion between the center of the pin 13 and the balance of the hinge mechanism will not define an arc as shown in FIG. 3 but would instead define a straight horizontal line passing through the center of the pin 13 shown in FIG. 3. It will be seen that the difference between the path 30, 31 of relatively large radius and a straight horizontal line passing through the center of the pin 13 in FIG. 3 would be negligible in terms of the spacing of the intersections thereof with the periphery of the pin 13 and thus the design considerations for the latch mechanism will be the same whether the axis of the pin 13 extends parallel or perpendicular to the axis of the door hinge, and thus normally to, or radially of, the arc, respectively, through which the door is pivoted from its fully opened to its fully closed position.

Figure 8:
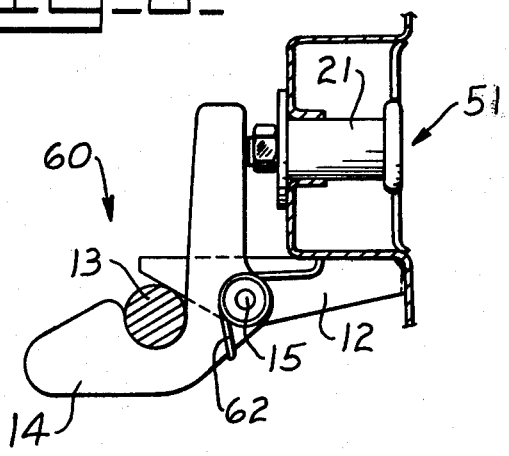
FIG. 8 is a fragmentary view similar to FIG. 6 but showing a different spring means for urging the latch mechanism to its latched position.

Referring to FIG. 8, a further embodiment 60 of the latch mechanism according to the teaching of this invention is shown which is identical to the embodiment 50 of FIGS. 5, 6 and 7 except that a torsion spring 62 is substituted for the tension spring 20 of embodiment 50. The use of torsion spring 62 will somewhat simplify the structure of the door handle 51. It should be noted that the plunger 21 is returned to its non-actuated position by the force of the tension spring 20 in embodiment 50 or torsion spring 62 in embodiment 60.

From the above it will be seen that an extremely simple and highly versatile door latching mechanism is provided according to the teaching of this invention. Such door latch mechanism will provide automatic latching features and will tend to prevent rattling of the door during operation of the vehicle. The gripping action of the latch mechanism on the cylindrical pin will tend to support the door. Such gripping action will also tend to damp out any vibrations to which the door is subjected by virtue of the frictional forces exerted on the periphery of the pin by its capture between the abutment surface and the hooking surface of the cam hook member. Since the latching mechanism of this invention involves only two moving parts, it will tend to be less subject to wear and jamming by dirt and dust under the severe environmental conditions to which it will be exposed during operation of the vehicle. The latching mechanism may be adapted to be quickly and easily installed on the doors of a wide variety of compartments of different design which often occur on a single large earth moving vehicle. The latch mechanism may be adapted to lock compartments containing removable items such as batteries, for example, without undue expense and use of such latch mechanism will tend to reduce the amount of noise generated by compartment doors when the vehicle is in operation.

I claim:

1. An anti-rattle mechanism for automatically and releasably latching a door to a body for pivotal movement through a given arc from a fully open position to a fully closed position, said mechanism comprising:

(a) first and second rigid support members, one of which is adapted to be mounted on said door and the other of which is adapted to be mounted on said body;

(b) a cylindrical pin rigidly mounted on said first support member and projecting therefrom with the axis of said pin extending normally to said given path of movement of said door;

(c) a cam hook member mounted on said second support member for pivotal movement about a given axis parallel to said axis of said pin;

(d) spring means urging said cam hook member to pivot in a given direction about said given axis; and (e) actuation means for selectively causing said cam hook member to pivot in the direction opposite said given direction about said given axis;

said second support member having a rigid abutment surface adapted to abut the periphery of said pin when said door is in said fully closed position on that side of the line defined by said axis of said pin and said given axis of pivotal movement of said cam hook member toward which said cam hook member is urged to move in said given direction by said spring means and on the same side of said pin as said given axis of pivotal movement of said cam hook member;

said cam hook member having a camming surface adapted to engage the periphery of said pin as said door approaches said fully closed position thereof causing said cam hook member to pivot in said direction opposite to said given direction about said given axis against said urging of said spring means, said camming surface of said cam hook member terminating in a hooking surface adapted to receive said pin when said door is in said fully closed position thereof and to compressively engage the periphery of said pin under the urging of said spring means at a point which is substantially opposite the abutment of said periphery of said pin by said rigid abutment surface of said second support member.

2. The latch mechanism as claimed in claim 1 wherein said door is hinged to said body for pivotal movement about an axis parallel to said axis of said cylindrical pin.

3. The latch mechanism as claimed in claim 1 wherein said door is hinged to said body for pivotal movement about an axis which when projected thereon is normal to said axis of said cylindrical pin extended as necessary for said projection thereon.

4. The latch mechanism as claimed in claim 1 wherein said first support member is mounted on said door and said second support member is mounted on said body.

5. The latch mechanism as claimed in claim 1 wherein said first support member is mounted on said body and said second support member is mounted on said door.

6. The latch mechanism as claimed in claim 5 wherein said actuation means comprises a plunger adapted to engage said cam hook member.

7. The latch mechanism as claimed in claim 1 wherein said spring means is a torsion spring operatively positioned about said given axis of said pivotal movement of said cam hook member.

8. The latch mechanism as claimed in claim 1 wherein said abutment surface of said second support member abuts a substantial part of that portion of the periphery of said pin on the same side of said pin as said given axis of pivotal movement of said cam hook member which extends from the intersection with said periphery of said line defined by said axis of said pin and said given axis of pivotal movement of said cam hook member to the intersection with said periphery of a line drawn through said axis of said pin normal to said given path of movement of said door.

9. The latch mechanism as claimed in claim 8 wherein said hooking surface of said cam hook member compressively engages a substantial part of that portion of the periphery of said pin on the opposite side thereof from said abutment of said second support member, which portion extends from the intersection of said path of movement of said door with said periphery to the intersection with said periphery of said line defined by said axis of said pin and said given axis of pivotal movement of said cam hook member.

10. An anti-rattle mechanism for automatically and releasably latching a door to a body for pivotal movement through a given arc from a fully open position to a fully closed position, said mechanism comprising:

a. first and second rigid support members, said first support member being mounted on said body and said second support member being mounted on said door;

b. a cylindrical pin rigidly mounted on said first support member and projecting therefrom with the axis of said pin extending normally to said given path of movement of said door;

c. a cam hook member mounted on said second support member for pivotal movement about a given axis parallel to said of said pin;

d. spring means urging said cam hook member to pivot in a given direction about said given axis;

e. actuation means comprising a plunger adapted to engage said cam hook member for selectively causing said cam hook member to pivot in the direction opposite said given direction about said given axis; and f. a flanged rectangular cup adpated to be received in a cut out in said door with the flange of said cup fixed to said door about the periphery of said cup, the bottom of said cup being apertured at one end thereof to receive said plunger with a sliding fit, said second supporting member being rigidly mounted on said cup adjacent said plunger with said plunger in operative relation to said cam hook member and with the opening of said rectangular cup being provided with a T-shaped web having its cross-bar extending transversely of said rectangular cup and its leg extending along the axis of elongation of said rectangular cup to the end thereof remote from said plunger;

g. said second support member having an abutment surface adapted to abut the periphery of said pin when said door is in said fully closed position on that side of the line defined by said axis of said pin and said given axis of pivotal movement of said cam hook member toward which said cam hook member is urged to move in said given direction by said spring means and on the same side of said pin as said given axis of pivotal movement of said cam hook member;

h. said cam hook member having a camming surface adapted to engage the periphery of said pin as said door approaches said fully closed position thereof causing said cam hook member to pivot in said direction opposite to said given direction about said given axis against said urging of said spring means, said camming surface of said cam hook member terminating in a hooking surface adapted to receive said pin when said door is in said fully closed position thereof and to compressively engage the periphery of said pin under the urging of said spring means at a point which is substantially opposite the abutment of said periphery of said pin by said abutment surface of said second support member.

* * * * *